US006422955B1

(12) United States Patent
Lopez

(10) Patent No.: US 6,422,955 B1
(45) Date of Patent: Jul. 23, 2002

(54) MAGNETIC GOLF BALL MARKER AND HOLDER

(76) Inventor: Ramon Lopez, 30512 Via Estoril, Laguna Niguel, CA (US) 92677

( * ) Notice: Subject to any disclaimer, the term of this patent is extended or adjusted under 35 U.S.C. 154(b) by 0 days.

(21) Appl. No.: 09/579,041

(22) Filed: May 25, 2000

(51) Int. Cl.[7] ..... A63B 57/00
(52) U.S. Cl. ..... 473/406; 224/918
(58) Field of Search ..... 473/406, 408, 473/285; 224/918

(56) References Cited

U.S. PATENT DOCUMENTS

| | | | | | |
|---|---|---|---|---|---|
| 3,136,547 | A | * | 6/1964 | Schaper | 473/406 |
| 3,139,690 | A | | 7/1964 | Hait | |
| 3,208,123 | A | | 9/1965 | Koos | |
| 3,233,802 | A | | 2/1966 | Ludwick | |
| 3,923,215 | A | | 12/1975 | Suzuki | |
| 4,130,950 | A | | 12/1978 | Bazzle et al. | |
| D252,289 | S | | 7/1979 | Furin | |
| 4,386,774 | A | * | 6/1983 | Buckman | 473/406 |
| 4,530,500 | A | | 7/1985 | Kaymen | |
| 4,736,877 | A | | 4/1988 | Clark | |
| 5,135,220 | A | | 8/1992 | Baldoni | |
| 5,282,616 | A | * | 2/1994 | Stacavich-Notaro | 473/406 |
| 5,305,999 | A | * | 4/1994 | Tate | 473/406 |
| D350,179 | S | | 8/1994 | Johnson | |
| 5,364,094 | A | | 11/1994 | Mustion | |
| D372,882 | S | | 8/1996 | Goldman et al. | |
| 5,569,103 | A | | 10/1996 | Sihn | |
| 5,643,114 | A | | 7/1997 | Marcus | |
| 5,898,946 | A | | 5/1999 | Keating et al. | |
| 5,996,116 | A | | 12/1999 | Tate | |
| 6,004,229 | A | | 12/1999 | Fazekas | |

* cited by examiner

*Primary Examiner*—Steven Wong
(74) *Attorney, Agent, or Firm*—James G. O'Neill

(57) ABSTRACT

A golf ball marker holding device for use by a golfer includes a top surface formed from a ferrous material, and having a low rim formed thereon and a rear surface having a pin secured thereto. A resilient, magnetic disk ball marker is held in a cavity defined by the low rim and the top surface, and is easily removed from the cavity to mark the location of a removed golf ball. The pin is secured in an article of clothing, and a butterfly-like clip is secured to the free end of the pin to hold the device to the article of clothing.

9 Claims, 1 Drawing Sheet

MAGNETIC GOLF BALL MARKER AND HOLDER

BACKGROUND OF THE INVENTION

1. Field of the Invention

This invention relates generally to golf ball markers and holding devices, and, more particularly, to a magnetic golf ball marker and carrying device for use by a golfer in a convenient and accessible manner.

2. Description of Related Art

As any golfer knows, when playing the game of golf, the golfer has need for ball markers to mark the location of a ball, during play. Depending on the clothes the golfer may be wearing or the equipment the golfer may be carrying, such golf markers may be carried in their pockets, a bag, or in or around a golf bag. However, because of their size and shape, it is difficult to quickly and locate such golf ball markers, or they tend to get caught in material, or in other items, making them difficult to extract from where they are located.

Many attempts have been made to solve this problem of carrying golf ball markers in a convenient and accessible place while playing a game of golf. One such attempt is set forth in U.S. Pat. No. 5,364,094 to Mustion ("'094"), which discloses a ball marking device comprised of an aluminum button having a pin attached to the rear thereof for securing the button to clothing on a golfer. The front surface of the button has a rubber-coated magnet secured thereto by glue. A stainless steel disc is attached to the magnet. When a golfer desires to mark his or her ball on a putting green, the golfer removes the stainless steel disc from the magnet. After use, the marker is returned to the magnet. However, during movement of the golfer, the disc may slip or become dislodged if it comes into contact with another item, surface, or the like. Or, the marker may not be properly secured on the button, and become lost or misplaced.

Other ball marker holding devices, including further magnetic holders having various securing means are shown in the following U.S. patents:

U.S. Pat. No. 3,139,690 to Hart
U.S. Pat. No. 3,233,802 to Ludwick
U.S. Pat. No. 3,208,123 to Koos
U.S. Pat. No. 5,135,220 to Baldoni
U.S. Pat. No. 5,643,114 to Marcus
U.S. Pat. No. 4,736,877 to Clark
U.S. Pat. No. 3,923,215 to Suzuki
U.S. Pat. No. 4,130,950 to Bazzle et al.
U.S. Pat. No. 5,996,116 to Tale
U.S. Pat. No. 6,004,229 to Fazekas
U.S. Pat. No. 5,893,946 to Keating et al.
Des. 252,289 to Furin
Des. 350,179 to Johnson
Des. 372,882 to Goldman et al.
U.S. Pat. No. 5,569,103 to Sihn
U.S. Pat. No. 4,530,500 to Kayman However, notwithstanding the many patents in this crowded art, there still exists a need in the art for a simple to use and easy to locate device for securely carrying but easily releasing a ball marker secured to any desired item of clothing on a golfer during play. The present invention was specifically designed to overcome this need and is felt to do so in a simple and inexpensive manner.

SUMMARY OF THE INVENTION

Accordingly, it is a general object of the present invention to provide a golf ball marker and holding device. It is a particular object of the present invention to provide a golf ball marker and holding device that may be firmly secured to an item of clothing, from which the ball marker is easily removed and returned to a secure position. It is a still more particular object of the present invention to provide a golf ball marker holding device having an outer rim structure that positively holds a golf ball marker in a readily accessible position. It is a still further particular object of the present invention to provide a small and easy to use golf ball marker holding device made from a metal that will hold a magnetized golf ball marker in position. And, it is still another particular object of the present invention to provide a golf ball marker holding device having a pin secured to a rear surface for securing the device to an item of clothing worn by a golfer, and which includes a holding portion made from metal and having a raised rim for positively supporting a resilient magnetic golf ball marker therein.

In accordance with one aspect of the present invention there is provided a holding device having a circular body with raised a rim formed on a front surface and a pin secured on the rear thereof for insertion through an article of clothing. The pin of the device includes a holding means to secure it in position. A resilient magnet ball marker is inserted and held in an opening defined by the raised rim on the front surface.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
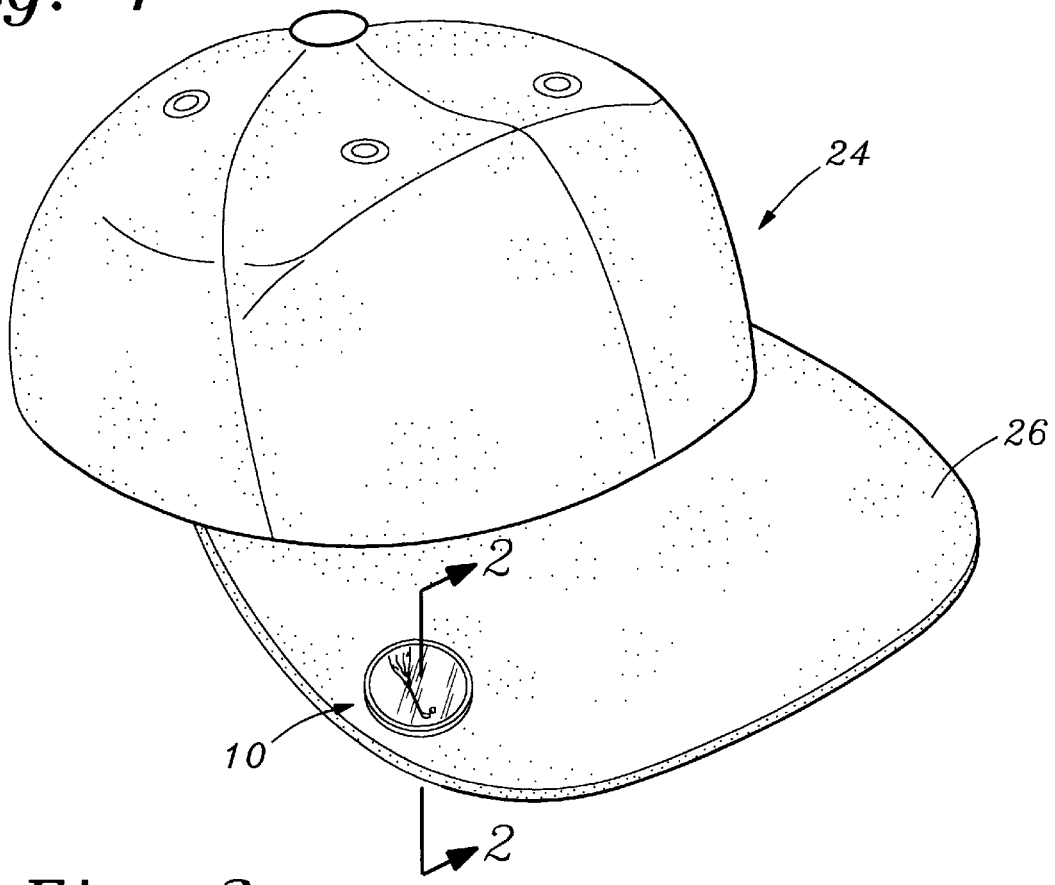
FIG. 1 is a perspective view of a cap having a preferred embodiment of a holding device and golf ball marker of the present invention inserted through and secured to a bill of the cap.
Figure 3:
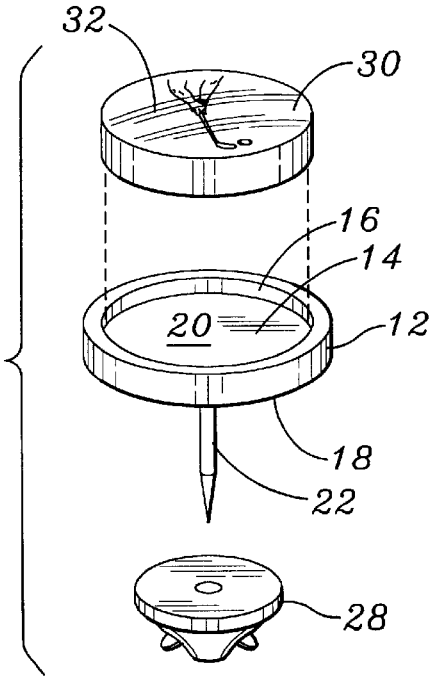
FIG. 3 is an exploded perspective view of the holding device and golf ball marker.
Figure 2:
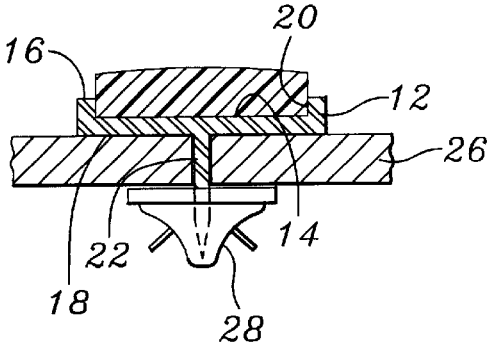
FIG. 2 is a cross-sectional view taken along line 2—2 of FIG. 1 of the holding device and golf ball marker.

The following description is provided to enable any person skilled in the art to make and use the invention and sets forth the best modes contemplated by the inventor of carrying out her invention. Various modifications, however, will remain readily apparent to those skilled in the art, since the generic principles of the present invention have been defined herein specifically to provide for an improved holding device and magnetic golf ball marker, generally identified at 10, for use by a golfer. 10 of the present invention is shown as having a body 12, which is preferably substantially circular in shape, having a front face or surface 14, a raised rim 16, which preferably has a low profile, a rear face or surface 18 and a cavity or opening 20 defined by an inside wall of the rim 16 and the top surface 14. The body 12 also has a pin 22 secured centrally in the rear face or surface 18 for insertion through an item of clothing of a golfer, such as a cap 24. As shown in FIG. 1, the elongated pin 22 is inserted through bill 26 of the cap or visor 24, and secured in position thereon by a pinch-in butterfly clip or holding element 28.

The body 12 may be formed from any desirable material or materials, in any desired shape and manner. In a preferred embodiment of the invention, the body is substantially circular and at least the front or upper surface 14 of the body 12 is formed from a ferrous material, such as stainless steel to securely hold a golf ball marker disk 30 within opening 20 defined by raised rim 16 of the body 12. The raised rim 16 may be formed straight, as shown, or may be formed at an angle over 90° to the front face 14, and/or rounded to merge with the body.

The golf ball marker disk 30 is preferably substantially circular and made from a resilient magnetic material, such as a magnetized plastic material, well known to those skilled in the art, which will readily adhere to the ferrous material of the body 12. The disk 30 is also preferably thicker than the height of the rim 16, to allow the resilient magnetic disk 30 to be easily removed and reinserted by the fingers of a golfer.

It is to be understood that the device of the present invention should be sized and dimensioned, so as to be easily worn and/or stored when not in use. Additionally, one or both sides, such as 32 of the disk 30, may be provided with a design or other indicia so that it may be used as an advertising specialty that may be manufactured at a low cost, and easily replaced, when needed.

It, therefore, can be seen that there has been provided a novel holding device and magnetic golf ball marker, which device and magnetic marker are easily added to or removed from an item of clothing, as desired, and which allows the golf ball marker to be easily removed and replaced.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A golf ball marking device for removably securing to a user's clothing, comprising:

a ferrous material body having a front surface removably holding a ball marker, and a rear surface having a pin mounted thereon, for securing the ferrous material body to a user's clothing;

a securing element removably held on the pin;

the front surface having a substantially flat portion with a raised rim formed around an outside edge of the substantially flat portion to define a cavity in the front surface; and the ball marker being made from a flexible magnetic material with a front side and a rear side, and being sized and dimensioned so that it fits in the cavity, against the substantially flat portion with the front side above an upper surface of the rim to enable the flexible magnetic material ball marker to be easily removed from the cavity.

2. The golf ball marker device of claim 1 wherein the ferrous material body and the flexible magnetic material ball marker are substantially circular.

3. The golf ball marking device of claim 2 wherein the securing element is a pinch-in butterfly type.

4. The golf ball marking device of claim 3 wherein the flexible magnetic material ball marker has a design or indicia printed on the front side.

5. The golf ball marking device of claim 1 wherein the flexible magnetic material ball marker has indicia printed on the front side.

6. The golf ball marking device of claim 5 wherein the flexible magnetic material ball marker and the body are substantially circular and the securing element is a pinch-in butterfly type.

7. A golf ball marking device for removably securing to a user's clothing, comprising:

a substantially circular ferrous material body having a front surface for removably holding a substantially circular ball marker, and a rear surface having a pin secured thereon, for securing to a user's clothing;

the pin having a pinch-in butterfly-type securing element removably held thereon;

the front surface having a substantially flat portion with a raised rim formed around an outside edge of the flat portion to define a cavity in the front surface holding the substantially circular ball marker; and the substantially circular ball marker being made from a flexible plastic magnetic material with a front side and a rear side, and being thicker than the raised rim, so that the front side is above a top surface of the raised rim to enable the flexible plastic magnetic material substantially circular ball marker to be easily removed from the cavity.

8. The golf ball marker device of claim 7, further including indicia printed on the front side of the flexible, plastic magnetic material substantially circular ball marker.

9. A golf ball marking device removably secured to a cap, comprising:

a cap having a brim;

a substantially circular ferrous material body having a substantially flat front surface for holding a substantially circular magnetic ball marker, and a rear surface for removably securing to the brim of the cap;

the rear surface having a pin secured thereon with a removable pinch-in butterfly-type securing element removably holding the golf ball marking device to the brim of the cap;

the substantially flat front surface having a raised rim formed around an outside edge of the flat front surface to define a cavity;

the substantially circular magnetic ball marker being made from a flexible plastic material and having a front side and a rear side, and being of a thickness such that it will be above an upper surface of the raised rim when held in the cavity so as to be easily removed from the cavity; and a design or indicia formed on the front side of the substantially circular magnetic ball marker.

* * * * *